US005360126A

United States Patent [19]

Snyder et al.

[11] Patent Number: 5,360,126

[45] Date of Patent: Nov. 1, 1994

[54] TAMPER-EVIDENT PLASTIC CLOSURE WITH 2-TIER BRIDGE ARRANGEMENT

[75] Inventors: William J. Snyder, Brockton; Rocco D. Walker, Hazleton, both of Pa.

[73] Assignee: Zapata Industries, Inc., Hazleton, Pa.

[21] Appl. No.: 994,299

[22] Filed: Dec. 21, 1992

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,335,889 | 8/1967 | Brumme | 215/252 |
| 3,904,062 | 9/1975 | Grussen | 215/252 |
| 4,494,664 | 1/1985 | Guala | 215/252 |
| 4,540,100 | 9/1985 | Wilis | 215/252 |
| 4,557,393 | 12/1985 | Boik | 215/253 |
| 4,573,601 | 3/1986 | Berglund | 215/252 |
| 4,805,792 | 2/1989 | Lecinski, Jr. | 215/253 |

FOREIGN PATENT DOCUMENTS

| | | | |
|---|---|---|---|
| 2309499 | 9/1974 | Germany | 215/252 |
| 2454273 | 5/1975 | Germany | 215/252 |
| 8905760 | 6/1989 | WIPO | 215/252 |

*Primary Examiner*—Allan N. Shoap
*Assistant Examiner*—Stephen Cronin
*Attorney, Agent, or Firm*—Shapiro and Shapiro

[57] ABSTRACT

A plastic closure has a tamper-evident band with a 2-tier bridge arrangement comprising upper and lower bridges that are staggered circumferentially of the band. The upper bridges are spaced along an upper line of weakness and connect the tamper-evident band to the side wall of the closure, while the lower bridges are spaced along a lower line of weakness and connect a lower portion of the tamper-evident band to an upper portion of the band. The lower portion has an internal locking bead for engaging an external locking shoulder on the neck of a container. When the closure is moved in a direction to remove it from the container, the upper portion of the band is deformed into a zig-zag shape. Eventually upper bridges, which are weaker than the lower bridges, break, so that at least a top part of the closure can be removed from the container.

8 Claims, 1 Drawing Sheet

TAMPER-EVIDENT PLASTIC CLOSURE WITH 2-TIER BRIDGE ARRANGEMENT

BACKGROUND OF THE INVENTION

This invention is concerned with tamper-evident closures, and more particularly with improved plastic closures having a 2-tier bridge arrangement in a tamper-evident band.

Plastic closures of the type used on oil containers or beverage containers are commonly provided with a tamper-evident band that breaks away from an upper part of the closure, either partially or completely, as the closure is moved to remove it from the container. For example, when a closure is unthreaded from a bottle, bridges that connect an upper part of the closure to a tamper-evident band constituting a lower part of the closure are designed to break, so as to give an indication that the bottle has been opened.

Most closures of the foregoing type employ a single tier or row of bridges spaced along a circumferential line of weakness, but closures employing a 2-tier bridge arrangement are also known. Those closures usually have axial lines of weakness in addition to upper and lower circumferential lines of weakness in their tamper-evident bands, and the closures are designed so that as they are moved to remove them from containers, a portion of the tamper-evident band between the upper and lower lines of weakness is either broken into separate pieces or tears away as a long strip..

In general, prior tamper-evident closures have bridges that may break prematurely -when the closure is applied to a container. Axial lines of weakness provide other sources of premature breakage. Strong bridges may avoid the problem of premature bridge breakage but tend to make the closure removal operation difficult to perform. Moreover, prior tamper-evident bands are subject to undesirable cocking or tilting during closure removal.

BRIEF DESCRIPTION OF THE INVENTION

The present invention provides an improved tamper-evident closure that significantly reduces premature bridge breakage during application of the closure to a container, that significantly reduces cocking or tilting of a tamper-evident band during removal of a closure from a container, and that provides clear evidence of the fact that the container has been opened.

The invention employs a tamper-evident band having a 2-tier bridge arrangement, in which weaker bridges are spaced along an upper line of weakness and stronger bridges are spaced along a lower line of weakness and are staggered circumferentially relative to the upper bridges. When the closure is moved to remove it from a container, an upper portion of the band between the lines of weakness is deformed into a zig-zag shape. Eventually, the weaker bridges break, leaving a distorted tamper-evident band on the container when a top part of the closure is removed from the container.

BRIEF DESCRIPTION OF THE DRAWINGS

The invention will be further described in conjunction with the accompanying drawings illustrating a preferred (best mode) embodiment, and wherein.

DETAILED DESCRIPTION OF THE INVENTION

Figure 1:
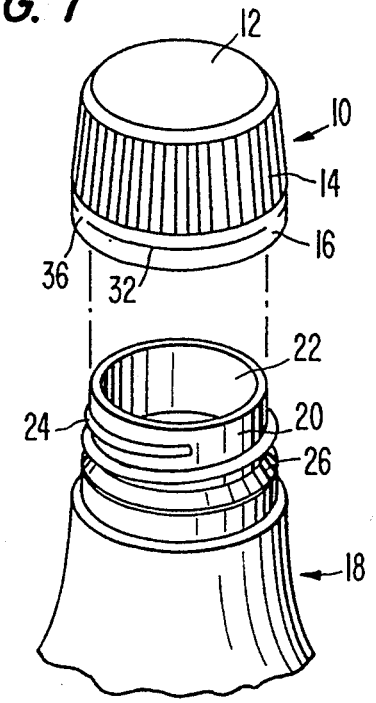
FIG. 1 is a perspective view showing a closure of the invention before application to a container.
Figure 3:
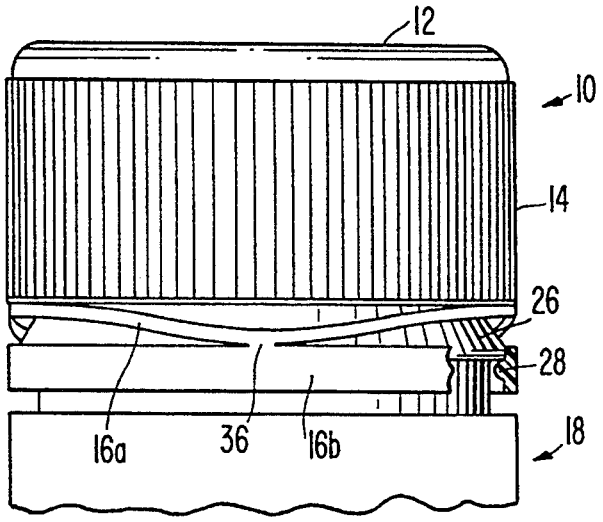
FIG. 3 is an elevational view showing an intermediate stage of closure removal.

As shown in FIG. 1, a plastic closure 10 in accordance with the invention, molded of polypropylene, for example, comprises a top part constituted by a top wall 12 and a side wall 14 depending therefrom, and a bottom part constituted by a tamper-evident band 16 depending from the side wall. The closure is shown ready for application to a conventional container 18, such as a plastic bottle having a neck 20 surrounding a dispensing opening 22. The neck has external threads 24 adapted to engage internal threads (not shown) on the side wall of the closure for releasably retaining the closure on the container, and has an external locking shoulder 26 adapted to engage an internal locking bead 28 formed on a lower portion **16*b* of the tamper-evident band, as shown in FIG. 3**. The locking bead may be a continuous or interrupted annulus or may be constituted by separate hooks, flaps, or tabs. It may also have a curled configuration of the type disclosed in U.S. Pat. No. 4,709,824, incorporated herein by reference. While the invention is not limited to closures having particular forms of seals, the curled linerless seal disclosed in that patent may be advantageously employed in the closures of the invention.

Figure 4:
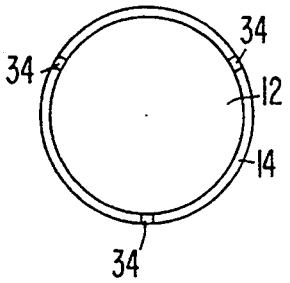
FIG. 4 is a bottom plan view of a top part of the closure.

The tamper-evident band has upper and lower annular lines of weakness 30 and 32, along which respective upper and lower bridges 34 and 36 are spaced, so as to form a 2-tier bridge arrangement. In the embodiment shown, the lines of weakness are formed by circumferential slits extending completely through the wall of the tamper-evident band. The slits of the upper line of weakness may be about 0.230 in. from the closure bottom, while the slits of the lower line of weakness may be about 0.160 in. from the closure bottom. In the form shown, each bridge tier includes three bridges, equally spaced circumferentially as shown in FIG. 4, but the invention is not limited to three bridges in each tier.

Figure 5:
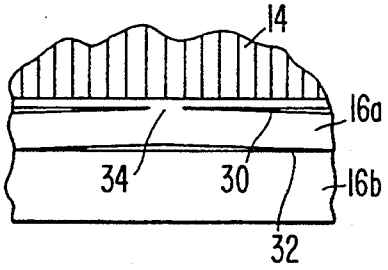
FIGS. 5 and 6 are fragmentary elevational views showing details of the tamper-evident band.
Figure 6:
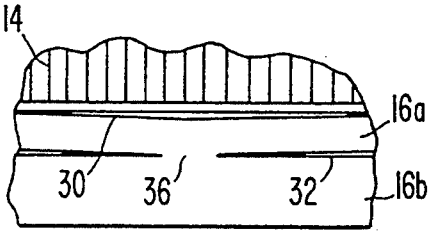

The bridges 34 of the upper tier are weaker than the bridges 36 of the lower tier. As shown in FIGS. 5 and 6, this can be accomplished by virtue of the circumferential dimensions of the bridges, i.e., the bridges 34 are narrower than the bridges 36 circumferentially (e.g., 0.025 in. and 0.050 in. circumferential width, respectively). The upper bridges 34 connect the upper portion **16*a* of the tamper-evident band to the side wall 14 of the closure, while the lower bridges 36 connect the upper portion 16*a* of the band to the lower portion 16*b*** of the band.

Figure 2:
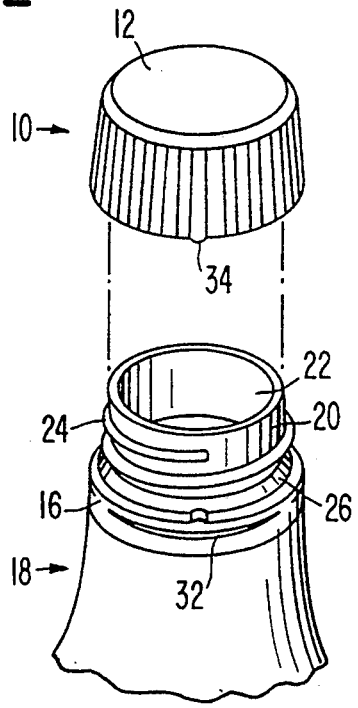
FIG. 2 is a similar view showing the closure after a removal operation.

When the closure 10 shown in FIG. 1 is applied to the neck 20 of the container 18, the locking bead 28 snaps over the shoulder 26 on the container neck. When the closure is fully applied to the container, cooperating locking surfaces of the shoulder and the bead may be spaced slightly from one another. However, when the closure is moved in a direction for removal of the closure from the container (i.e., in a direction to disengage the cooperating threads of the closure and the container), engagement of the locking bead of the closure with the locking shoulder of the container, as shown in FIG. 3, resists removal of the closure. Movement of the top part of the closure in the removal direction causes the upper bridges 34 to move upwardly relative to the lower bridges 36 and causes the upper portion 16*a* of the tamper-evident band to become deformed into a zig-zag shape, as shown in FIG. 3. Eventually, the weak upper bridges 34 break, so that the top part of the closure can be removed from the container, as shown in FIG. 2, while the bottom part of the closure, constituted by the distorted tamper-evident band, remains on the container.

The 2-tier bridge arrangement of the invention provides several advantages. First, it significantly reduces bridge breakage during application of the closure to a container, apparently because the stronger bridges bear a considerable portion of the application forces. Second, the tendency of a tamper-evident band to cock or tilt during a closure removal operation is significantly reduced, because the deformed upper portion of the tamper-evident band, between the tiers of bridges, pulls on the lower portion of the band evenly (preventing the application of strong localized forces to the lower portion of the band), so that the tamper-evident band remains parallel to the locking shoulder of the container. Third, the distortion of the tamper-evident band provides clear visual evidence of the fact that the closure has been removed.

While a preferred embodiment of the invention has been shown and described, it will be apparent to those skilled in the art that changes can be made in this embodiment without departing from the principles and spirit of the invention, the scope of which is defined in the appended claims. For example, while the lines of weakness are shown constituted by slits that may be knife-cut after a plastic closure is molded, the lines of weakness may be grooves formed in the closure molding operation, or one line of weakness may be a molded line of weakness and the other a knife-cut line of weakness. The zig-zag portion of the tamper-evident band may be removed from a container together with the upper part of the closure by providing one or more strong bridges in the upper tier. Furthermore, principles of the invention may be applied to a metal closure.

The invention claimed is:

1. A plastic closure for a container having a neck surrounding a dispensing opening, the neck having means for releasably retaining the closure thereon and having an external locking shoulder, said closure comprising a top part including a top wall and a side wall depending from the top wall, and a bottom part including a tamper-evident band depending from the side wall, the band having a lower portion with an internal locking bead adapted to engage said locking shoulder so as to resist removal of the closure from the container, and having an upper portion between upper and lower annular lines of weakness, and means for facilitating the deformation of said upper portion of said band into a zig-zag shape when the closure is moved relative to the neck of the container in a direction to remove the closure from the container, said means including bridges spaced along each line of weakness, the bridges of the upper line of weakness connecting the tamper-evident band to the side wall of the closure, and the bridges of the lower line of weakness connecting the lower portion of the tamper-evident band to the upper portion of the tamper-evident band, the bridges of the lower line of weakness being stronger than bridges of the upper line of weakness and being staggered circumferentially of the bank with respect to bridges of the upper line of weakness, whereby when the closure is moved relative to the neck of the container in a direction to remove the closure from the container, the bridges of the upper line of weakness move upwardly relative to the bridges of the lower line of weakness and the upper portion of the band is deformed into said zig-zag shape, and whereby, when the closure is further moved in said direction, bridges of the upper line of weakness break, so that at least the top part of the closure may be separated from the container.

2. A closure according to claim 1, wherein each line of weakness comprises a series of slits.

3. A closure according to claim 1, wherein bridges of the upper line of weakness are narrower circumferentially of the band than the bridges of the lower line of weakness.

4. A closure according to claim 1, wherein there are three equally-spaced bridges of the upper line of weakness and three-equally spaced bridges of the lower line of weakness.

5. In combination with a container having a neck surrounding a dispensing opening, the neck having means for releasably retaining a closure thereon and having an external locking shoulder, a plastic closure comprising a top part including a top wall and a side wall depending from the top wall, and a bottom part including a tamper-evident band depending from the side wall, the band having a lower portion with an internal locking bead adapted to engage the locking shoulder so as to resist removal of the closure from the container, and having an upper portion between upper and lower annular lines of weakness, and means for causing said upper portion of said band to deform into a zig-zag shape when the closure is moved relative to the neck of the container in a direction to remove the closure from the container, said means including bridges spaced along each line of weakness, the bridges of the upper line of weakness connecting the tamper-evident band to the side wall of the closure, and the bridges of the lower line of weakness connecting the lower portion of the tamper-evident band to the upper portion of the tamper-evident band, the bridges of the lower line of weakness being stronger than bridges of the upper line of weakness and being staggered circumferentially of the band with respect to the bridges of the upper line of weakness, whereby when the closure is moved relative to the neck of the container in a direction to remove the closure from the container, the bridges of the upper line of weakness move upwardly relative to the bridges of the lower line of weakness and the upper portion of the band is deformed into said zig-zag shape, and whereby, when the closure is further moved in said direction, bridges of the upper line of weakness break, so that at least the top part of the closure may be separated from the container.

6. A combination according to claim 5, wherein each line of weakness comprises a series of slits.

7. A combination according to claim 5, wherein bridges of the upper line of weakness are narrower circumferentially of the band than the bridges of the lower line of weakness.

8. A combination according to claim 5, wherein there are three equally-spaced bridges of the upper line of weakness and three equally-spaced bridges of the lower line of weakness.

* * * * *